US005080005A

United States Patent [19]

Kolt

[11] Patent Number: 5,080,005

[45] Date of Patent: Jan. 14, 1992

[54] PASSIVE BUILDING VENTS

[75] Inventor: Stanley Kolt, Mamaroneck, N.Y.

[73] Assignee: Leonard W. Suroff, Jericho, N.Y. ; a part interest

[21] Appl. No.: 639,045

[22] Filed: Jan. 9, 1991

[51] Int. Cl.[5] ..... F24F 7/00

[52] U.S. Cl. ..... 454/359; 454/361; 454/259; 454/277; 454/194

[58] Field of Search ..... 98/42.17, 119, 1.5, 98/95, 99.4, 99.3, 42.01, 42.16, 42.23, 32, 42.19, 78, 79

[56] References Cited

U.S. PATENT DOCUMENTS

| | | | |
|---|---|---|---|
| 1,081,195 | 12/1913 | Austin | 98/95 |
| 1,623,286 | 4/1927 | Strahan | 98/119 |
| 2,790,377 | 4/1957 | Pryne | 98/119 |
| 4,593,504 | 6/1986 | Bonnici et al. | 98/42.16 |

FOREIGN PATENT DOCUMENTS

| | | | |
|---|---|---|---|
| 1915719 | 10/1978 | Fed. Rep. of Germany | 98/42.01 |

*Primary Examiner*—Albert J. Makay
*Assistant Examiner*—William C. Doerrler
*Attorney, Agent, or Firm*—Leonard W. Suroff

[57] ABSTRACT

A passive building vent disposed in an outside vertical building wall, communicates between the outside atmospheric air and the confined air within the building, via a housing forming an air mixing chamber with a passageway disposed therethrough. A movable membrane is mounted within the housing at one end of the passageway, the other end of the passageway communicates with the confined air and is disposed outside of the vertical building wall. The membrane has a closed position, substantially blocking the passageway and an open position, permitting the free flow of air therethrough. The air passage permits the flow of outside air into the air mixing chamber. A venting device communicates with the air mixing chamber permitting the flow of air to exit from the air mixing chamber. A deflector is mounted on the housing proximate the venting device and communicates with the air mixing chamber. The deflector is inclined relative to the membrane and interposes between the membrane and the venting device wherein the flow of outside air entering through the air passage impinges upon the deflector and is forced to exit through the venting device providing a pressure differential such that the membrane is caused to move to its open position permitting the free flow of the air through the passageway into the air mixing chamber for venting the building.

45 Claims, 3 Drawing Sheets

FIG. 1
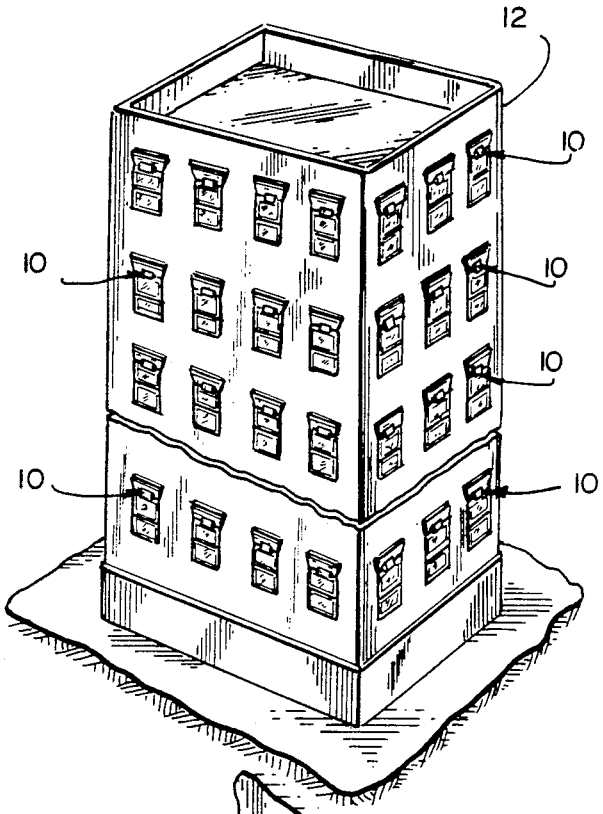
FIG. 1A
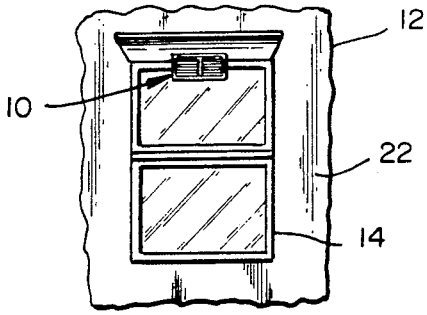
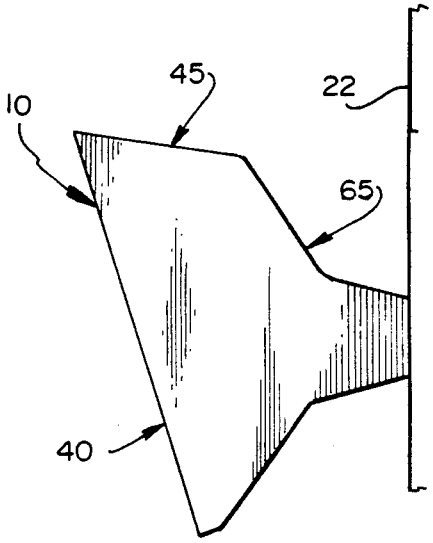
FIG. 3
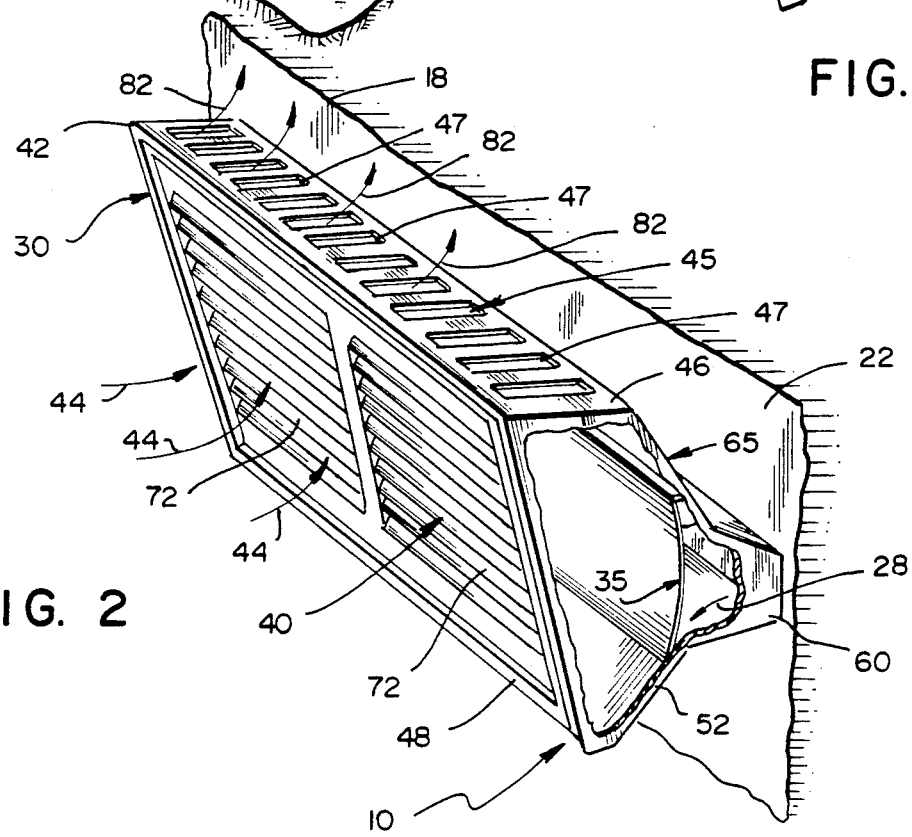
FIG. 2

PASSIVE BUILDING VENTS

BACKGROUND OF THE INVENTION

1. Field of the Invention

The present invention relates to vents, and more particularly to a passive building vent which is suitable for installation in the outside wall of a multi-story building thereby equalizing the air pressure within the building to the outside atmospheric pressure.

2. Discussion of the Relevant Art

Numerous types of building vents are in use today. Their specific purpose is to provide a device for exhausting air from a confined space to the outside when the confined air either reaches a prescribed temperature or odoriferous particles have been trapped within the confined space and it is desirable to release the confined air to the outside atmosphere. In some instances these vents are utilized in conjunction with attic vents, which may be passive or powered, and they assist in the discharge of the confined air to the outside atmosphere.

Typical of these vents is an energy saver damper assembly disclosed in U.S. Pat. Nos. 4,591,092, 4,596,181 and 4,567,816 invented by the inventor of the subject invention. In addition to providing the normal venting function, the unidirectional vent provides for the equalizing of air pressures should a sudden drop in the outside or atmospheric air occur, such as experienced during tornados or other violent air disturbances. The unique property of the unidirectional vent is that it permits a prescribed amount of air to escape from a confined air space yet it provides for an instantaneous increase in the amount of air permitted to escape with sudden drops in outside or atmospheric air pressure. The feature prevents the confined air from causing damage to windows, and the like, with sudden drops of atmospheric air pressure.

The instant invention is ideally suited for use in multi-story buildings wherein the confined inner space may be continuously equalized with the outside atmospheric air and when combined with the unidirectional air vent can compensate for sudden drops in the outside atmospheric pressure. Thus the normal "chimney-like" effect which is caused in multi-story or high rise buildings when they are provided with a central heating or air conditioning system may now be eliminated, since the air pressure at each story is equalized to the outside air pressure. This decreases if not eliminates the drawing in of additional outside air into the system which would require additional capacity for the heating and air conditioning systems utilized therein.

Water seeks its own level. In a similar way, if moisture is not provided an engineered path, it will find its own way out of a building. Most often this will be in the least desirable fashion—through the structure itself, causing, at worst, severe structural degradation. Common symptoms are failed pointing on walls (which results in months of effort and huge dollar outlays), and the impairment of the roof through - successively - blistering, cracking, leaking, and ultimately disintegration. If ambient (airborne, environmental) moisture remains trapped, micro-organisms (mold, fungus) will grow. This has an adverse effect on the health and productivity of tenants and employees.

If buildings are vented in accordance with the present invention, moisture exits through designed pathways. The structural integrity of the building is maintained. Building facia remains intact and walls do not accumulate mold. The roof underlayment remains dry and roof life is extended. In addition, ambient moisture leaves through the vents, the conditions which enable mold to thrive are eliminated, and both health and productivity of occupants are maintained. A well-vented, dry building will not manifest the "sick building" syndrome.

The passive venting system of the present invention uses no fans, motors, or electricity, and is continuously working. The passive vent is also easily retrofitted into most shapes and styles of window. It also has the advantage of moving air in one direction only, exhausts internal air continuously, allows no infiltration, conserves energy, windows remain closed and is tamper-resistant. The passive vent also addresses all indoor air quality problems in apartments and office buildings, which are mold and mildew, condensation and dripping windows, odors and obnoxious smells, and sick building syndrome.

OBJECTS OF THE INVENTION

Therefore, it is an object of the present invention to provide a passive building vent which is reliable and easily installable in multi-story buildings.

It is another object of the present invention to provide a reliable building vent capable of equalizing the air pressures between the confined air space and the atmospheric air with sudden drops in atmospheric air pressure.

It is another object of the present invention to provide a passive building vent suitable for use in high rise buildings which insures that the confined building air may be vented to the outside even when circulating atmospheric air currents flow in an upwardly direction.

It is yet another object of the present invention to provide a method for venting a multi-story building when low velocity outside atmospheric winds impinge directly upon the passive building vent.

It is still another object of the present invention to provide a passive building vent that provides for venting the confined air into the outside atmospheric air automatically as normal winds impinge directly upon the passive building vent.

The present apparatus overcomes the shortcomings of the known art by providing a reliable, relatively inexpensive, venting apparatus which is passive and contains only one moving part.

SUMMARY OF THE INVENTION

A passive building vent disposed in an outside vertical building wall, in operative relationship to an opening provided in the outside building wall for communicating between the outside atmospheric air and the confined air within the building that includes a housing means adapted to be disposed in the building opening between the confined air and the outside air forming an air mixing chamber and having a passageway disposed therethrough. Movable membrane means are mounted within the housing means at one end of the passageway, the other end of the passageway communicating with the confined air and disposed outside of the vertical building wall, with the membrane means having a closed position, substantially blocking the passageway and an open position, permitting the free flow of air therethrough, and the membrane means being in its closed position when at rest.

Air passage means is disposed on the housing means for permitting the flow of outside air into the air mixing chamber, with venting means disposed in the upper surface of the housing means communicating with the air mixing chamber for permitting the flow of air to exit from the air mixing chamber, and deflector means mounted on the housing means proximate the venting means and communicating with the air mixing chamber. The deflector means being inclined relative to the membrane means and interposed between the membrane means and the venting means, wherein the flow of outside air entering through the air passage means impinges upon the deflector means and is forced to exit through the venting means providing a pressure differential such that the membrane means is caused to move to its open position permitting the free flow of the air through the passageway into the air mixing chamber for venting the building.

The air passage means is provided with vanes for diverting the outside air towards the venting means and may include a plurality of horizontally extending louvres with upwardly extending openings. The air passage means is disposed at an upwardly and outwardly extending angle relative to the membrane means in its closed position, wherein wind or warm thermals that radiate off of the building rise and can pass through the vanes into the air mixing chamber.

The foregoing and other objects and advantages will appear in the description to follow. In the description reference is made to the accompanying drawing which forms a part hereof, and which is shown by way of illustration specific embodiments in which the invention may be practiced. The embodiments will be described in sufficient detail to enable one skilled in the art to practice the invention and it is to be understood that other embodiments may be utilized and that structural changes may be made without departing from the scope of the invention. In addition the passive building vent may be mounted in an inverted or vertical position relative to that shown in the drawings and also be used. The following detailed description is, therefore, not to be taken in a limited sense wherein like reference numerals refer to like parts throughout the several views, and the scope of the present invention it is best to find by the appended claims.

BRIEF DESCRIPTION OF THE DRAWING

In order that the invention may be more fully understood, it will now be described, by way of example, with reference to the accompanying drawing in which:

FIG. 1 is a perspective pictorial representation of a multi-story building in which the apparatus of the instant invention is installed;

FIG. 1A is an enlarged fragmentary view of the apparatus of the present invention installed in an outside wall of the building;

FIG. 2 is an enlarged perspective view of the apparatus shown in FIG. 1 installed in an outside wall of the building;

FIG. 3 is a side view of the apparatus of the present invention installed in an outside wall of the building;

DESCRIPTION OF THE PREFERRED EMBODIMENTS

Figure 4:
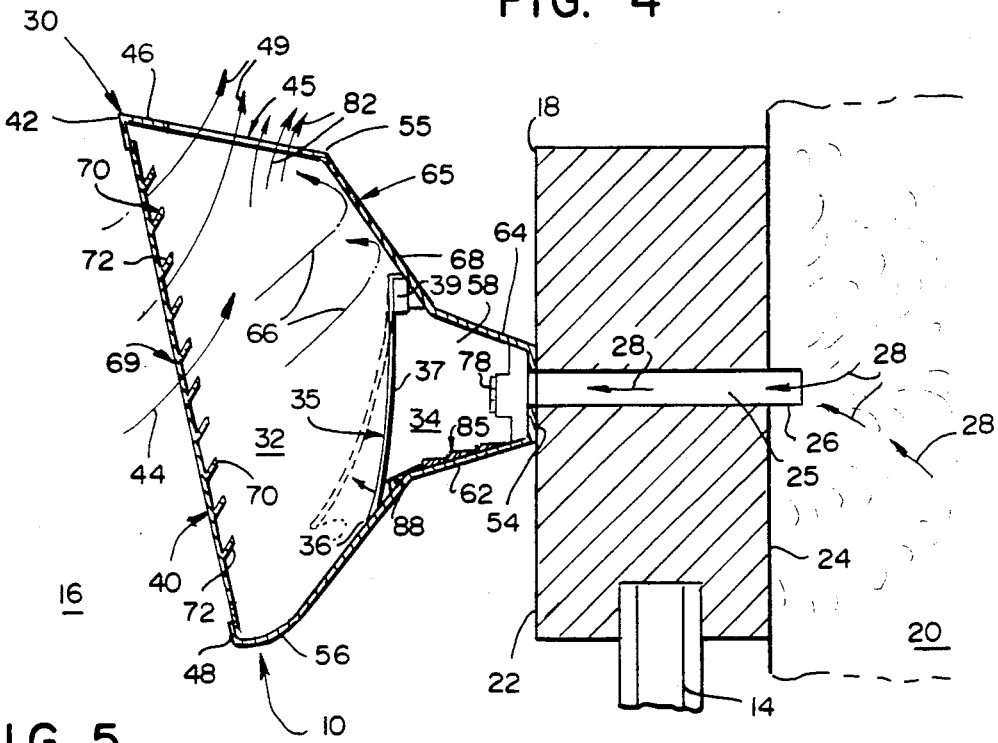
FIG. 4 is an enlarged cross-sectional view of the passive air vent, according to the principles of the present invention.

Referring now to the figures, and in particular to FIGS. 1 through 4, which show the passive building vent 10 installed in a plurality of positions proximate the ceilings of each of a plurality of floors in a multi-story building 12. Typically these multi-story buildings are used for apartment houses, industrial or commercial use. The windows 14 provided therein may be of the type generally not made to open or of a conventional style in apartment houses that can be opened. Thus, each of the floors in a multi-story commercial type building is at a different atmospheric pressure, since there is no opening or venting to the outside atmosphere 16. As is well known by those knowledgeable in the art, when providing heating and cooling, normally positioned in the basement of the building, to the various floors, a chimney effect occurs, thus causing additional atmospheric air to enter the building as the forced air is pushed to the upper stories during heating and air conditioning. The addition of outside or atmospheric air into the building increases the load on the heating and cooling systems. A plurality of the passive building vents 10 being installed in or on the outside vertical wall 18 which communicates between the confined air space in the building causes the equalization of the confined air 20 with the outside atmospheric air 16.

Referring now to FIGS. 2 through 7 which show the passive building vent 10 installed in an outside building wall 18 which may be installed from the outside or exterior surface 22 of the wall 18 and communicates with the inside or interior surface 24. An opening 25 is provided between the interior surface 24 and exterior surface 22. The opening 25 may be formed by a conduit 26 formed of a plastic or metallic material formed to coincide with the shape of the vent 10, to permit a flow of confined air 20 in the direction of arrows 28 in the manner hereinafter described in detail.

Figure 5:
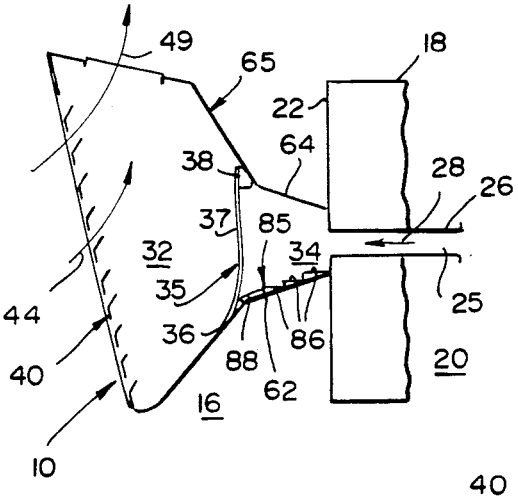
FIG. 5 is a pictorial representation of the apparatus in elevation, showing the position of the venting membrane with relatively low velocity air passing therethrough.
Figure 6:
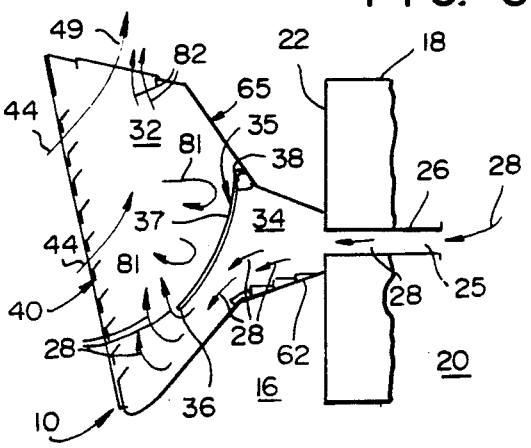
FIG. 6 is a pictorial representation of the apparatus in elevation with relatively high velocity air passing therethrough.

As further illustrated in FIGS. 2, 3 and 4, the passive building vent 10 may be disposed on the outside building wall 22, in operative relationship to the opening 25 provided in the outside building wall 22 for communicating between the outside atmospheric air 16 and the confined air 20 within the building 12. The vent 10 includes housing means 30 adapted to be disposed in communicating relationship with the building opening 25 between the confined air 20 and the outside air 16 forming an air mixing chamber 32 and having a passageway 34 disposed therethrough and communicating with opening 25. Movable membrane means 35 is mounted within the housing means 30 at one end of the passageway 34, the other end of the passageway 34 communicating with the confined air 20 and disposed outside of the vertical building wall 22, with the membrane means 35 having a closed position as illustrated in FIG. 5, substantially blocking the passageway 34 and an open position as illustrated in FIG. 6, permitting the free flow of confined air 20 therethrough in the direction of arrows 28. The membrane means 35 is in its closed position when at rest by gravitational forces as illustrated in FIGS. 4 and 5 and has a lower free edge or end 36 and an upper fixed edge or end 38 at each end of the flexible member 37. The flexible member 37 may be fabricated from MYLAR and is between ½ mils and approximately 2 mils thick. An ideal thickness has been found to be ½ mils thick. The upper edge 38 may be connected to support means 39 coupled to the housing means 30. The upper edge 38 may be adhesively secured to the support means 39 as one form of attachment. Other forms of securment may also be used as well as various other flexible materials.

Air passage means 40 is disposed at the outside distal end 42 of the housing means 30 for permitting the flow of outside air 16 as illustrated in the direction of arrows 44 into the air mixing chamber 32, with venting means 45 disposed in the upper surface 46 of the housing means communicating with the air mixing chamber 32 for permitting the flow of air to exit from the air mixing chamber 32. The venting means 45 may include a plurality of spaced apart slots or grooves 47 that may vary in configuration and size to permit air to exit therethrough as illustrated by the arrows 49.

Figure 7:
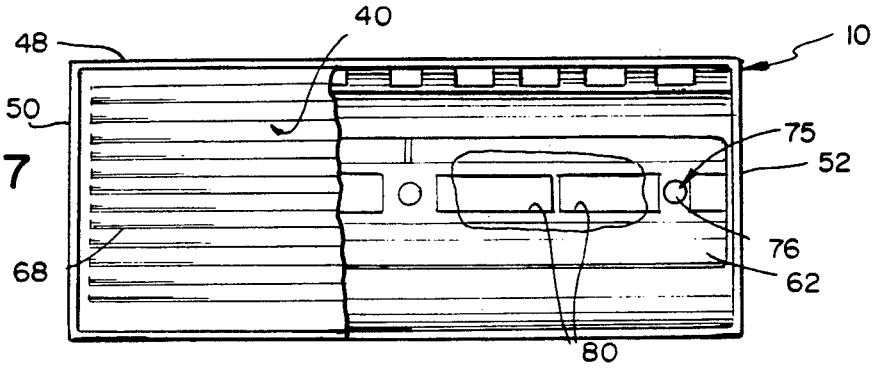
FIG. 7 is a front view, partially broken away, of the apparatus of the present invention.

The housing means 30 may have an elongated configuration as seen in FIGS. 2 and 7 and fabricated from a plastic material to include a front wall 48 connected to a pair of side wall portions 50 and 52 affixed to the front wall 48. One configuration of the housing means 30 may be in which the side walls 50 and 52 are about 7" apart and the height of the housing means 30 is about 2.75". Obviously the dimensions may vary accordingly. A rear wall 54 is affixed to the side walls 50 and 52, and an upper wall 55 forms the upper surface 46 of the housing means 30. A bottom wall 56 connects the rear wall 54 to the front wall 48. The passage means 40 is in communicating relationship to the front wall 48 and the venting means 45 is in communicating relationship to the upper surface 46.

The upper surface 46 may be inclined upwardly relative the vertical wall 54 at an angle of approximately 5 degrees to 15 degrees or be fabricated in a horizontal plane. An angle of approximately 9 degrees has been found to operate well. The side walls 50 and 52 may have a contoured configuration with rear sections or portions 58 and 60, respectively. The sections 58 and 60 may be tapered to terminate at the rear wall 54. In addition, to guide the flow of air 20 in the direction of arrows 28, the bottom wall 56 may have a tapered rear end or section 62 and the upper wall 55 may have a tapered rear end or section 64.

Deflector means 65 is mounted on the housing means 30 proximate the venting means 45 and communicating with the air mixing chamber 32. The deflector means 65 being inclined relative to the membrane means 35 and interposed between the membrane means 35 and the venting means 45, wherein the flow of outside air 16 entering through the air passage means 40 impinges upon the deflector means 65 as illustrated by arrows 66 in FIG. 4, and is forced to exit through the venting means 45 providing a pressure differential such that the membrane means 35 is caused to move to its open position as illustrated in FIG. 6, permitting the free flow of the air 20 through the passageway 34 into the air mixing chamber 32 for venting the building 12. The deflector means 65 includes a deflector member 68 that is inclined at an angle relative to the vertical plane defined by the rear wall 54 or the movable membrane means 35 when in its vertical position as illustrated in FIGS. 4 and 5. The inclined angle of deflector member 68 may be in the range of 30 degrees to 60 degrees and preferably at approximately 45 degrees.

The air passage means 40 is provided with vanes 69 for diverting the outside air 16 towards the deflector means 45 and may include a plurality of horizontally extending louvres 70 with upwardly extending or inclined shoulders 72. The air passage means 40 is disposed at an upwardly and outwardly extending angle which may be in the range of 15 degrees to 45 degrees relative to the membrane means 35 in its closed position, wherein wind or warm thermals that radiate off of the building 12 rise and can pass through the vanes 69 into the air mixing chamber 32. An angle approximately 20 degrees has been found suitable.

The passive building vent 10 further includes mounting means 75 for removably coupling the housing means 30 to the building 12. As illustrated in FIG. 7, the mounting means 75 is adapted at one end thereof for affixing the building vent 10 to the outside vertical wall 22 of the building 12. The mounting means 75 may include spaced apart holes 76 that are adapted to receive a bolt or fastener 78 therethrough which as illustrated in FIG. 4 may extend through the wall 18. It is understood that holes will be provided in the wall 18 which may be the frame of the window 14 or even the glass itself. An adhesive bonding could also be used to secure the building vent 10 in fixed relationship to the building 12.

The operation of the passive building vent is best illustrated together with FIGS. 4, 5, and 6. FIG. 2 and 5 disclose the position of the movable membrane means 35 under steady state conditions with the vent 10 installed in the building 12 and without atmospheric air flow impinging upon the deflector means 65. The unidirectional vent 10 is initially in its closed positioned, as shown in FIGS. 4 and 5. In its open position or fully open condition, as shown in the broken lines in FIG. 2 or the open position in FIG. 6 the mylar membrane means 35 is free to move with air currents as shown.

The atmospheric air impinges on the passive building vent 10 through the air passage means 40 in the direction of arrows 44 and 66 (FIG. 4), with a certain amount of air impinging upon the deflector means 65 to essentially cause the free end 36 of the flexible member 37 to move to the open position illustrated in FIG. 6. Air exiting from the confined air space 20 will take the path shown by the arrows 28, through elongated apertures 80 (See FIG. 7), around the free end 36 of the flexible member 37 and will then move into the air mixing chamber 32 and essentially move in a manner as illustrated by arrows 81 and then move upwardly as illustrated by arrows 82 that exit through the openings or slots 47 illustrated in FIG. 3. Obviously the configuration of the slots 47 and apertures 80 may vary in size, shape and configuration.

The air paths will be as that shown in FIG. 6 and will flow in the direction of arrows 28, 81 and 82 and the confined air 20 will be removed from the building 12. The exiting confined air 20 in the building 12 will combine with the atmospheric air 16 and exit from the venting means 45 in a unique method. Thus, regardless of the velocity of the atmospheric air speed or its direction, venting can be accomplished from the confined air space 20 to the outside atmosphere 16. If a sudden drop of atmospheric pressure should occur, the membrane 37 moves toward its vertical or rest position as illustrated in FIGS. 4 or 5 thereby preventing the confined air 20 to exit the building and thus, equalize the pressure instantaneously. Accordingly the angle of inclination of the louvres 70 forces the inwardly directed air indicated by arrows 44 to be projected against the surface of the deflector means 65 which is inclined relative to the membrane means 35 and thereafter exiting through the venting means 45. The surface formed by the venting means 45 may be inclined as illustrated or perpendicular to the vertical plane of the building 12. Concurrently as the external air 16 flows as above described, an initial differential of pressure is created causing the free end 36 of the flexible member to move outwardly creating a path for the exiting of the confined air 20 such that the air can flow and exit from the building through the mixing chamber 32 and thereafter exit through the venting means 45 in the same direction as the outside air 16.

To prevent the membrane means 35 from being deflected under pressure towards the passageway 34, such as by a strong rain or water from a hose which could permit the entry of water or other liquid into the passageway 34 and in turn the building 18, there is provided resisting or stop means 85. One such embodiment being illustrated in FIGS. 4 and 5 illustrates that the resisting means includes a plurality of steps 86 contained on the rear end 62 with a front step or stop 88 in abutting relationship to the flexible member 37. In this manner a dual function is performed in that the stop 88 prevents the rearward flexing of the membrane 37 and further the stops 86 also prevent water from flowing upstream in case any would seep through.

Figure 8:
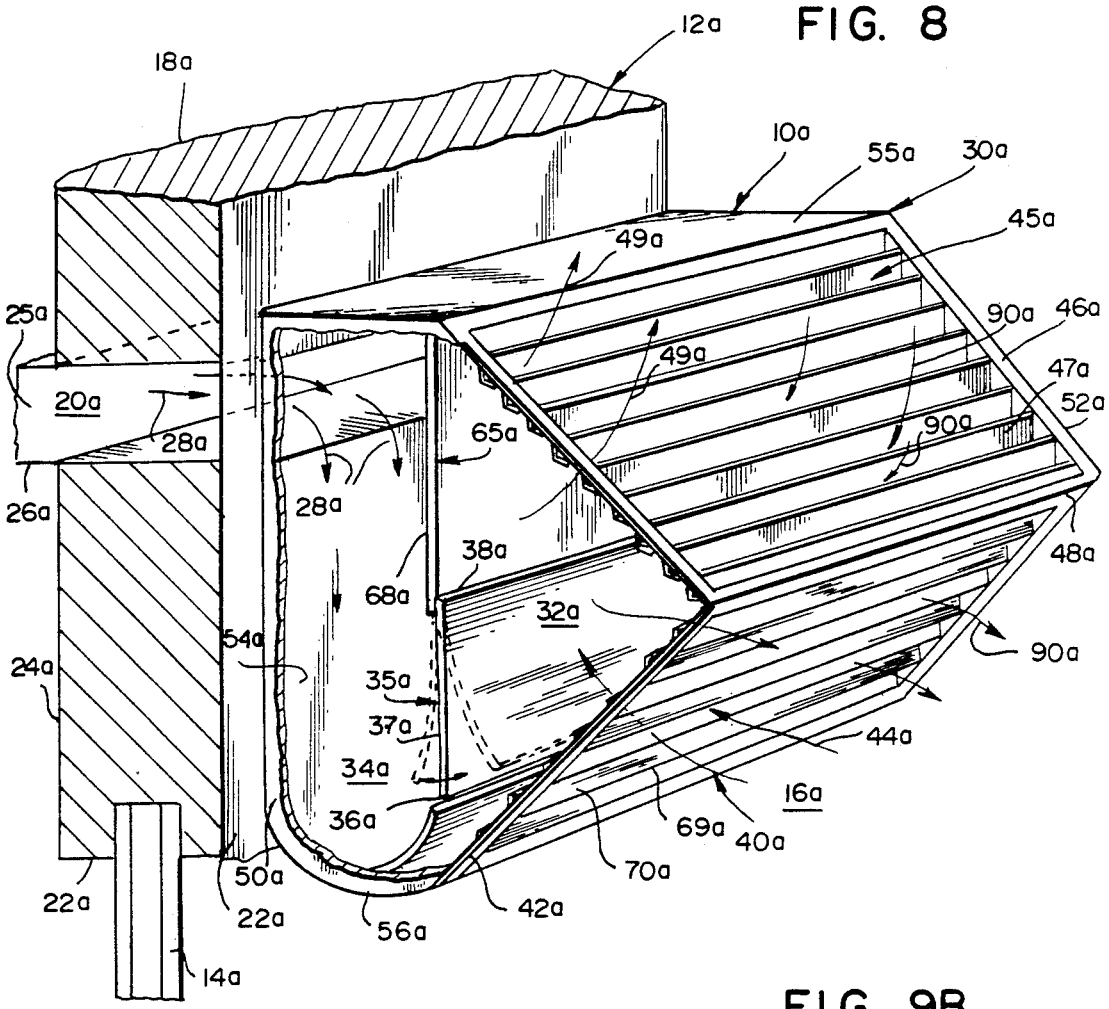
FIG. 8 is a perspective view of another embodiment of the present invention, partially in section installed in an outside wall of the building.
Figure 9A:
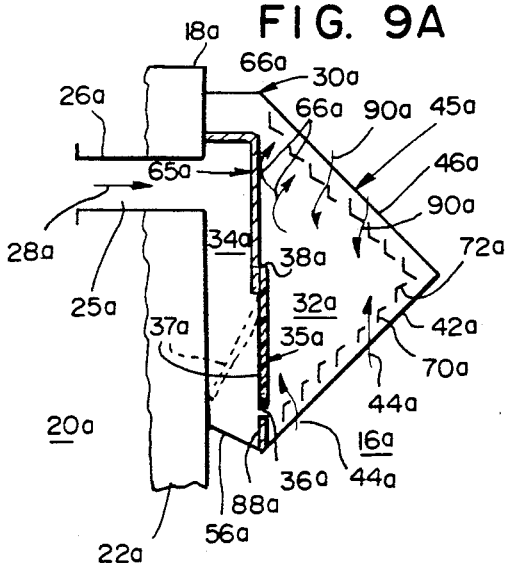
FIG. 9A is a pictorial representation of the apparatus in elevation, showing the position of the venting membrane with relatively low velocity air passing therethrough.
Figure 9B:
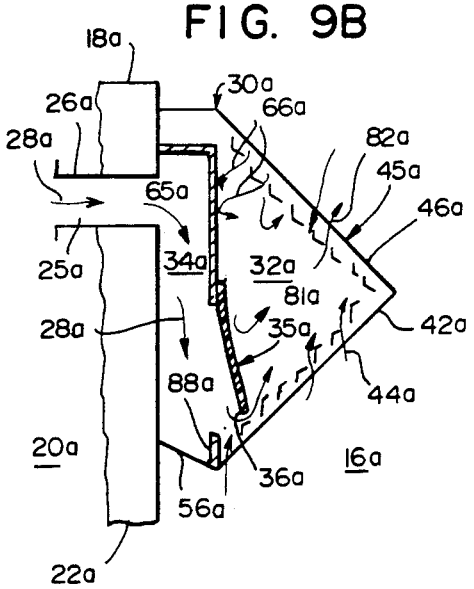
FIG. 9B is a pictorial representation of the apparatus in elevation with relatively high velocity air passing therethrough.

Referring now to FIGS. 8, 9A and 9B, which show the passive building vent 10*a* installed in a position similar to that illustrated in FIGS. 1–7 of a multi-story building 12*a*. The windows 14*a* provided therein may be of the type generally not made to open or of a conventional style in apartment houses that can be opened. Thus, each of the floors in a multi-story commercial type building is at a different atmospheric pressure, since there is no opening or venting to the outside atmosphere 16*a*. As is well known by those knowledgeable in the art, when providing heating and cooling, normally positioned in the basement of the building, to the various floors, a chimney effect occurs, thus causing additional atmospheric air to enter the building as the forced air is pushed to the upper stories during heating and air conditioning. The addition of outside or atmospheric air into the building increases the load on the heating and cooling systems. A plurality of the passive building vents 10*a* being installed in or on the outside vertical wall 18*a* which communicates between the confined air space in the building causes the equalization of the confined air 20*a* with the outside atmospheric air 16*a*.

The passive building vent 10*a* is installed in an outside building wall 18*a* which may be installed from the outside or exterior surface 22*a* of the wall 18*a* and communicates with the inside or interior surface 24*a*. An opening 25*a* is provided between the interior surface 24*a* and exterior surface 22*a*. The opening 25*a* may be formed by a conduit 26*a* formed of a plastic or metallic material formed to coincide with the shape of the vent 10*a*, to permit a flow of confined air 20*a* in the direction of arrows 28*a* in the manner hereinafter described in detail.

The passive building vent 10*a* may be disposed on the outside building wall 22*a*, in operative relationship to the opening 25*a* provided in the outside building wall 22*a* for communicating between the outside atmospheric air 16*a* and the confined air 20*a* within the building 12*a*. The vent 10*a* includes housing means 30*a* adapted to be disposed in communicating relationship with the building opening 25*a* between the confined air 20*a* and the outside air 16*a* forming an air mixing chamber 32*a* and having a passageway 34*a* disposed therethrough and communicating with opening 25*a*. Movable membrane means 35*a* is mounted within the housing means 30*a* at one end of the passageway 34*a*, the other end of the passageway 34*a* communicating with the confined air 20*a* and disposed outside of the vertical building wall 22*a*, with the membrane means 35*a* having a closed position as illustrated in FIG. 9A, substantially blocking the passageway 34*a* and an open position as illustrated in FIG. 9B, permitting the free flow of confined air 20*a* therethrough in the direction of arrows 28*a*. The membrane means 35*a* is in its closed position when at rest by gravitational forces as illustrated in FIGS. 8 and 9A and has a lower free edge or end 36*a* and an upper fixed edge or end 38*a* at each end of the flexible member 37*a*. The flexible member 37*a* may be fabricated from Mylar and is between ½ mils and approximately 2 mils thick. An ideal thickness has been found to be ½ mils thick. The upper edge 38*a* may be connected to the housing means 30*a* in a variety of ways. The upper edge 38*a* may be adhesively secured to the deflector means 65*a* as one form of attachment. Other forms of securment may also be used as well as various other flexible materials. The free edge 36*a* may be spaced from the housing partition or neck 88*a* to provide an air gap therebetween.

Air passage means 40*a* is disposed at one outside end 42*a* of the housing means 30*a* for permitting the flow of outside air 16*a* as illustrated in the direction of arrows 44*a* into the air mixing chamber 32*a*, with venting means 45*a* disposed in the upper surface 46*a* of the housing means 30*a* communicating with the air mixing chamber 32*a* for permitting the flow of air to exit from the air mixing chamber 32*a*. The venting means 45*a* may include a plurality of spaced apart slots, grooves or louvers 47*a* that may vary in configuration and size to permit air to exit therethrough as illustrated by the arrows 49*a*.

The housing means 30*a* may have an elongated configuration as seen in FIG. 8 and fabricated from a plastic material to include a front wall 48*a* connected to a pair of side wall portions 50*a* and 52*a* affixed to the front wall 48*a*. One configuration of the housing means 30*a* may be in which the side walls 50*a* and 52*a* are about 7" apart and the height of the housing means 30*a* is about 2.75". Obviously the dimensions may vary accordingly. A rear wall 54*a* is affixed to the side walls 50*a* and 52*a*, and an upper wall 55*a* forms the upper surface 46*a* of the housing means 30*a*. A bottom wall 56*a* connects the rear wall 54*a* to the front wall 48*a*. The passage means 40*a* is in communicating relationship to the front wall 48*a* and the venting means 45*a* is in communicating relationship to the upper surface 46*a*.

The upper surface 46*a* may be inclined upwardly relative the vertical wall 54*a* at an angle of approximately 30 degrees to 60 degrees. An angle of approximately 45 degrees has been found to operate well. The side walls 50*a* and 52*a* may have a contoured configuration with the housing partition or neck 88*a* extending upwardly from the bottom wall 56*a*.

Deflector means 65*a* is mounted on the housing means 30*a* proximate the venting means 45*a* and communicating with the air mixing chamber 32*a*. The deflector means 65*a* in this embodiment of the invention may be in vertical alignment with the membrane means 35*a*. The flow of outside air 16*a* entering through the air passage means 40*a* may in part impinge upon the deflector means 65*a* as illustrated by arrows 66*a* in FIG. 9B, and is forced to exit through the venting means 45*a* providing a pressure differential such that the membrane means 35*a* is caused to move to its open position as illustrated in FIG. 9B, permitting the free flow of the air 20*a* through the passageway 34*a* into the air mixing chamber 32*a* for venting the building 12*a*. The deflector means 65*a* includes a deflector member 68*a* that may be parallel to the rear wall 54*a* or the movable membrane means 35*a* when in its vertical position as illustrated in FIG. 9A.

The air passage means 40*a* is provided with louvers or vanes 69*a* for diverting the outside air 16*a* into the mixing chamber 32*a* and towards the deflector means 45*a* and may include a plurality of horizontally extending louvres 70*a* with upwardly extending or inclined shoulders 72*a*. The air passage means 40*a* is disposed at an upwardly and outwardly extending angle which may be in the range of 15 degrees to 60 degrees relative to the membrane means 35*a* in its closed position, wherein wind or warm thermals that radiate off of the building 12*a* rise and can pass through the vanes 69*a* into the air mixing chamber 32*a*. An angle approximately 45 degrees has been found suitable.

The passive building vent 10*a* further includes mounting means for removably coupling the housing means 30*a* to the building 12*a*, which may be in the form illustrated in FIGS. 1–7.

The operation of the passive building vent 10*a* is best illustrated together with FIGS. 9A and 9B. FIG. 9A discloses the position of the movable membrane means 35*a* under steady state conditions with the vent 10*a* installed in the building 12 and without atmospheric air flow impinging upon the deflector means 65*a*. The unidirectional vent 10*a* is initially in its closed positioned, as shown in FIG. 9A. In its open position or fully open condition, as shown in FIG. 9B or the open position in FIG. 8 the mylar membrane means 35*a* is free to move with air currents as shown and the air 20*a* may exit therethrough.

The atmospheric air 16*a* impinges on the passive building vent 10*a* through the air passage means 40*a* in the direction of arrows 44*a* and 66*a* (FIG. 4), with a certain amount of air impinging upon the deflector means 65*a* to essentially cause the free end 36*a* of the flexible member 37*a* to move to the open position illustrated in FIG. 9B. Air exiting from the confined air space 20*a* will take the path shown by the arrows 28*a*, around the free end 36*a* of the flexible member 37*a* and will then move into the air mixing chamber 32*a* and essentially move in a manner as illustrated by arrow 81*a* and then move upwardly as illustrated by arrows 82*a* that exit through the openings or slots 47*a* illustrated in FIG. 8. Obviously the configuration of the slots 47*a* and apertures 80*a* may vary in size, shape and configuration.

The air paths will be as that shown in FIG. 9B and will flow essentially in the direction of arrows 28*a*, 81*a*, and 82*a* and the confined air 20*a* will be removed from the building 12*a*. The exiting confined air 20*a* in the building 12*a* will combine with the atmospheric air 16*a* and exit from the venting means 45*a* in a unique method. Thus, regardless of the velocity of the atmospheric air speed or its direction, venting can be accomplished from the confined air space 20*a* to the outside atmosphere 16*a*. If a sudden drop of atmospheric pressure should occur, the membrane 37*a* moves toward a closed position illustrated in FIG. 9A thereby preventing the confined air 20*a* to exit the building and thus, equalize the pressure instantaneously. Accordingly the angle of inclination of the louvres 70*a* forces the inwardly directed air indicated by arrows 44*a* to be projected against the surface of the deflector means 65*a* and thereafter exiting through the venting means 45*a*. The surface formed by the venting means 45*a* may be inclined relative to the vertical plane of the building 12*a*. Concurrently as the external air 16*a* flows as above described, an initial differential of pressure is created causing the free end 36*a* of the flexible member to move outwardly creating a path for the exiting of the confined air 20*a* such that the air can flow and exit from the building through the mixing chamber 32*a* and thereafter exit through the venting means 45*a* in the same direction as the outside air 16*a*. In this embodiment a certain amount of external air 16*a* will flow through the housing means 30*a* as illustrated by arrows 90*a* by entering the venting means 45*a* and exiting through the air passage means 40*a*. This flow through aids in creating the pressure differential to obtain the movement of the membrane means 35*a* from its normal position to its open position in FIG. 9B.

Accordingly a strong rain or water from a hose would not enter the passageway 34*a* and in turn the building 18*a*. A dual function is performed by the rearward flexing of the membrane 37*a* as seen in FIG. 9A since it prevents water from flowing upstream in case any would seep through.

Hereinbefore has been disclosed a passive building vent which is inexpensive, reliable and capable of venting confined air within a building to the outside atmosphere under all conditions of and velocities of the atmospheric air impinging upon the passive building vent such that a novel method of venting a building is also obtained.

I claim:

1. A passive building vent adapted to be disposed in an outside vertical building wall, in operative relationship to an opening provided in said building wall for communicating between the outside atmospheric air and the confined air within said building comprising:

(A) housing means including an air mixing chamber and a passageway communicating therewith, said passageway adapted to be disposed continuous to said building opening wherein said confined air can flow through said passageway and into said air mixing chamber;

(B) movable membrane means mounted within said housing means at one end of said passageway, the other end of said passageway communicating with said confined air, said membrane means movable between a closed position substantially blocking said passageway and an open position permitting the free flow of air therethrough;

(C) air passage means communicating with said housing means for permitting the flow of outside air into said air mixing chamber;

(D) venting means disposed in the upper surface of said housing means communicating with said air mixing chamber for permitting the flow of air to exit from said air mixing chamber, and (E) deflector means mounted on said housing means proximate said venting means and communicating with said air mixing chamber, wherein the flow of outside air entering through said air passage means impinges upon said deflector means and is forced to exit through said venting means providing a pressure differential such that said membrane means is caused to move to its open position permitting the free flow of said air through said passageway into said air mixing chamber for venting the building.

2. A passive building vent according to claim 1 wherein said air passage means is provided with vanes for diverting said outside air towards said venting means.

3. A passive building vent according to claim 2 wherein said vanes include a plurality of horizontally extending louvres with upwardly extending openings.

4. A passive building vent according to claim 3 wherein said air passage means is disposed at an upwardly and outwardly extending angle relative to said membrane means in its closed position, wherein wind or warm thermals that radiate off of said building rise and can pass through said vanes into said air mixing chamber.

5. A passive building vent according to claim 1 wherein said membrane means is disposed in its closed position responsive to gravitational forces.

6. A passive building vent according to claim 5 wherein said membrane means has a free edge and is affixed to said housing means along the edge opposite from said free edge.

7. A passive building vent according to claim 1 wherein said membrane means is made from MYLAR.

8. A passive building vent according to claim 1 wherein said membrane means is between approximately ½ mil and 2 mil thick.

9. A passive building vent according to claim 8 wherein said membrane means is approximately ½ mil thick.

10. A passive building vent according to claim 1 wherein said housing means includes:

(a) a front wall, (b) a pair of side wall portions affixed to said front wall, (c) a rear wall affixed to said side walls, and (d) an upper wall forming the upper surface of said housing means.

11. A passive building vent according to claim 10 wherein said passage means is in communicating relationship to said air front wall.

12. A passive building vent according to claim 1 and further including mounting means for removably coupling said housing means to said building.

13. A passive building vent according to claim 12 wherein said mounting means is adapted at one end thereof for affixing the building vent to the outside vertical wall of said building.

14. A passive building vent according to claim 1 wherein said deflector means is inclined relative to said membrane means at an angle from 30 degrees to 60 degrees.

15. A passive building vent according to claim 14 wherein said angle is approximately 45 degrees.

16. A passive building vent according to claim 1 wherein said venting means includes a plurality of slots to permit said free flow of air.

17. A passive building vent according to claim 1 and further including resisting means in operative relation to said membrane means to prevent said membrane means from being forced inward under pressure which would permit rain to enter said air passage means.

18. A passive building vent according to claim 17 wherein said resisting means includes at least one stop in abutting relationship to said membrane means.

19. A passive building vent according to claim 18 wherein said stop includes a series of steps extending into said air passageway.

20. A passive building vent according to claim 1 wherein said deflector means is in substantial vertical alignment with said membrane means.

21. A passive building vent adapted to be mounted in operative relationship to an outside vertical building wall having an opening provided in said building wall for communicating between the outside atmospheric air and the confined air within said building comprising:

(A) housing means adapted to be disposed in operative relation to said building opening between said confined air and said outside air forming an air mixing chamber and having a passageway disposed therethrough;

(B) movable membrane means mounted within said housing means at one end of said passageway, the other end of said passageway communicating with said confined air, and disposed outside of said vertical building wall, said membrane means having a closed position, substantially blocking said passageway and an open position, permitting the free flow of air therethrough, said membrane means being in said closed position when at rest;

(C) air passage means disposed at the outside distal end of said housing means for permitting the flow of outside air into said air mixing chamber;

(D) venting means disposed in the upper surface of said housing means communicating with said air mixing chamber for permitting the flow of air to exit from said air mixing chamber, and (E) deflector means mounted on said housing means proximate said venting means and communicating with said air mixing chamber, said deflector means being inclined relative to said membrane means and interposed between said membrane means and said venting means, wherein the flow of outside air entering through said air passage means impinges upon said deflector means and is forced to exit through said venting means providing a pressure differential such that said membrane means is caused to move to its open position permitting the free flow of said air through said passageway into said air mixing chamber for venting the building.

22. A passive building vent according to claim 21 wherein said air passage means is provided with vanes for diverting said outside air towards said venting means.

23. A passive building vent according to claim 22 wherein said vanes include a plurality of horizontally extending louvres with upwardly extending openings.

24. A passive building vent according to claim 23 wherein said air passage means is disposed at an upwardly and outwardly extending angle relative to said membrane means in its closed position, wherein wind or warm thermals that radiate off of said building rise and can pass through said vanes into said air mixing chamber.

25. A passive building vent according to claim 21 wherein said membrane means is disposed in its closed position responsive to gravitational forces.

26. A passive building vent according to claim 25 wherein said membrane means has a free edge and is affixed to said housing means along the edge opposite from said free edge.

27. A passive building vent according to claim 21 wherein said membrane means is made from MYLAR.

28. A passive building vent according to claim 21 wherein said membrane means is between approximately ½ mil and 2 mil thick.

29. A passive building vent according to claim 28 wherein said membrane means is approximately ½ mil thick.

30. A passive building vent according to claim 21 wherein said housing means includes:

(a) a front wall, (b) a pair of side wall portions affixed to said front wall, (c) a rear wall affixed to said side walls, and (d) an upper wall forming the upper surface of said housing means.

31. A passive building vent according to claim 30 wherein said passage means is in communicating relationship to said front wall.

32. A passive building vent according to claim 21 and further including mounting means for removably coupling said housing means to said building.

33. A passive building vent according to claim 32 wherein said mounting means is adapted at one end thereof for affixing the building vent to the outside vertical wall of said building.

34. A passive building vent according to claim 21 wherein said deflector means is inclined relative to said membrane means at an angle from 30 degrees to 60 degrees.

35. A passive building vent according to claim 34 wherein said angle is approximately 45 degrees.

36. A passive building vent according to claim 21 wherein said venting means includes a plurality of slots to permit said free flow of air.

37. A passive building vent according to claim 21 and further including resisting means in operative relation to said membrane means to prevent said membrane means from being forced inward under pressure which would permit rain to enter said air passage means.

38. A passive building vent according to claim 37 wherein said resisting means includes at least one stop in abutting relationship to said membrane means.

39. A passive building vent according to claim 38 wherein said stop includes a series of steps extending into said air passageway.

40. The method of providing a continuous air path in a building with a passive building vent comprising the steps of:

(A) providing an air mixing chamber within a housing means communicating between the confined air space within said building and the outside atmospheric air;

(B) providing a movable membrane mounted within said housing means at one end of said air mixing chamber, whereby said membrane has a closed position, substantially blocking said air mixing chamber and an open position, permitting the free flow of air from within said building into said air mixing chamber, said membrane being in said closed position when at rest;

(c) providing an air passage disposed on said housing means for permitting the flow of outside air into said air mixing chamber;

(D) providing venting means on said housing means in communicating relationship with said air mixing chamber for permitting the flow of air to exit from said air mixing chamber; and (E) providing a deflector mounted on said housing means and communicating with said air mixing chamber, whereby the flow of outside air entering through said air passage means impinges upon said deflector and is forced to exit through said venting means providing a pressure differential such that such said membrane is caused to move to its open position permitting the free flow of said air into said air mixing chamber for venting the building.

41. A method according to claim 40 further including the step of mounting said housing means to said building.

42. A method according to claim 40 further including the step of providing a passageway communicating with said air mixing chamber at one end thereof and said confined air space at said other end outside of said building.

43. A method according to claim 40 further including the step of preventing the flow of liquid past said movable membrane and into said air passageway.

44. A method according to claim 43 further including the step of providing a stop in abutting relation to said movable membrane whereby rain is prevented from entering said air passageway and in turn said building.

45. A method according to claim 40, further including the step of positioning said deflector proximate said venting means and relative to said membrane and interposed between said membrane and said venting means.

* * * * *